US005341789A

United States Patent [19]

Paglia

[11] Patent Number: 5,341,789

[45] Date of Patent: Aug. 30, 1994

[54] ARROW REST WITH INTEGRATED ARROW HOLDER

[76] Inventor: John Paglia, 1680 Narcissa, Blue Bell, Pa. 19422-2505

[21] Appl. No.: 54,155

[22] Filed: Apr. 30, 1993

[51] Int. Cl.[5] ..... F41B 5/22

[52] U.S. Cl. ..... 124/44.5; 124/24.1

[58] Field of Search ..... 124/23.1, 24.1, 25.6, 124/44.5, 86, 88

[56] References Cited

U.S. PATENT DOCUMENTS

| | | | |
|---|---|---|---|
| 3,769,956 | 11/1973 | Simo | 124/44.5 |
| 3,828,757 | 8/1974 | Finlay | 124/44.5 |
| 4,318,390 | 3/1982 | Trotter | 124/44.5 |
| 4,407,261 | 10/1983 | Elliott | 124/44.5 |
| 4,676,220 | 6/1987 | Pietraszek | 124/44.5 |
| 4,809,669 | 3/1989 | Saunders | 124/24.1 |
| 4,919,115 | 4/1990 | Miller | 124/24.1 |
| 5,009,215 | 4/1991 | Ludwig | 124/44.5 |
| 5,161,515 | 11/1992 | Hammonds | 124/44.5 |

*Primary Examiner*—Randolph A. Reese
*Assistant Examiner*—John A. Ricci

[57] ABSTRACT

An arrow rest that successfully integrates an arrow holder into its design. The body member has an arrow rest arm and an arrow holder arm. An arrow is placed on the rest and held in position prior to being drawn and released. This is accomplished by pinching the arrow between the arrow holding arm and the arrow rest arm with spring tension. As the arrow is drawn the arrow holder arm is rotated until it can no longer maintain it's holding position. The holder arm is then urged by spring tension to its passive position on an inclined shelf where it will not interfere with the arrow fletching but is readily available for further use.

18 Claims, 1 Drawing Sheet

ARROW REST WITH INTEGRATED ARROW HOLDER

BACKGROUND

1. Field of Invention

This invention relates to arrow rests and arrow holders, specifically to an arrow rest that successfully integrates an arrow holder into its design in a simple and economical manner.

2. Discussion of Prior Art

In order to launch an arrow from a bow, the arrow must first be placed in position and held on the bow. The arrow is placed in position subsequent to drawing and releasing by placing the arrow on an arrow rest and nocking the arrow on the string with one's hands and fingers. If the arrow will be drawn and released immediately, only an arrow rest is needed. The arrow rest, along with the fingers, provides sufficient support to hold the arrow in position for draw and release; but if the arrow is allowed to remain on the rest, without being held by the fingers prior to draw and release, it is subject to being dislodged from the bow. This can cause a serious safety hazard due to the razor sharp broadheads used by the modern bowhunter.

When it is desired to leave the arrow on the bow and not discharge the arrow immediately, an arrow holder is needed. This becomes most obvious to the hunter who by necessity must have his or her arrow in position and ready to shoot. It is necessary during long hours of hunting to rest and relax the hands and fingers. The bow and arrow must be released by the hands and placed on an object of support. The arrow will dislodge from the arrow rest and possibly from the bow if not properly supported. Although not recommended some bowhunters, especially those employing tree stands, keep the bow and arrow nocked, ready, and hanging from a tree limb or other such support. This is a dangerous condition, particularly so, if an arrow holder is not used. An arrow holder is a necessary safety device for the modern bowhunter because it promotes greater safety when it is needed to rest one's hands or attend to some other task while hunting. It also helps to mitigate the dangerous practice of suspending an unattended bow nocked with an arrow and broadhead.

The arrow rest is in a crowded field of art. The arrow rest, in addition to supporting the arrow prior to discharge, must also allow the arrow to fly straight and true when launched. A multitude of designs has addressed this need.

There are few prior art arrow holders and these are bulky and difficult to use, requiring two hands to implement. In my invention only the index finger and thumb of one hand are needed to place the arrow holder in its proper position. Most of these prior arts do not adjust to the various size arrow shafts in use. An arrow holder should be able to adjust to the various size diameters of the arrows being used in modern archery. My design addresses this need in a simple and straight forward manner.

Still fewer, are arrow rests that encompass an arrow holder in their design, and none combine the two with the simplicity and ease of use of this design; a design that promotes safety due to its ease of use.

OBJECTS AND ADVANTAGES

It is the object of this invention to provide an arrow rest that integrates an arrow holder into its design. A design that will increase safety in the sport of archery because it is easy to use, and conveniently placed.

It is another object of this invention to provide an arrow rest with integrated arrow holder that is simple and convenient to use, needing only one finger to operate and readily adjust to different size arrow shafts.

It is another object of this invention to provide an arrow rest with integrated arrow holder that has few parts and is relatively inexpensive to manufacture.

It is another object of this invention to provide an arrow rest with integrated arrow holder that is versatile and easily adapts to the various types of bows in archery. One that can be mounted through the bow handle riser with a thread rod or attached adhesively to the side.

With the above and other objects in view, the present invention consists of the combination and arrangement of parts herein more fully described, and illustrated in the accompanying drawings, and more particularly, that changes may be made in the form, size, proportions, and minor details of construction without departing from the spirit or sacrificing any of the advantages of the invention.

DESCRIPTION AND OPERATION

Figure 1:
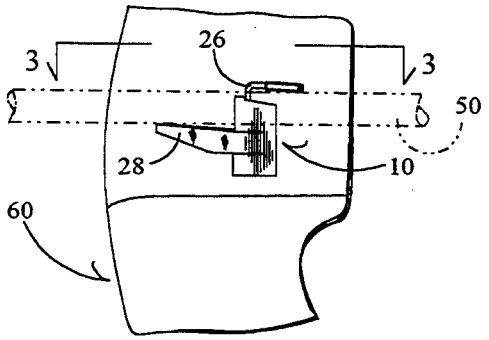
FIG. 1 is a front elevation with phantom lines view of an arrow rest with integrated arrow holder according to the present invention in combination with a fragmentary representation of a bow and arrow with the holding arm in the holding, active position.

Now with particular reference to the drawings, drawings numbered alphanumerically show closely related objects;

In FIG. 1 the arrow 50 is positioned on the arrow rest arm 28 of the arrow rest holder assembly 10 that is mounted on the bow handle riser portion 60 and the arrow holder arm 26 is in the active, holding, position on top of the arrow 50. Only the index finger and thumb of one hand are needed to move the arrow holder arm 26 from its passive to active positions. The thumb holds the arrow 50 on the arrow rest arm 28 while the forefinger rotates the arrow holder arm 26 away from the handle riser 60 in a clockwise direction until it contacts the side of the arrow 50. Additional pressure is imparted to the arrow holder arm 26, compressing the tension spring as the arm 26 moves up the side of the arrow 50 until it reaches its top and holding position.

Figure 2:
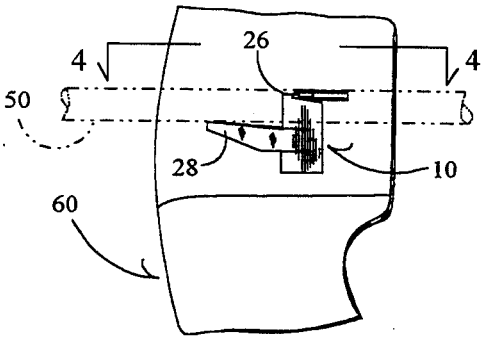
FIG. 2 is a front elevation with phantom lines view of an arrow rest with integrated arrow holder according to the present invention in combination with a fragmentary representation of a bow and arrow with the holding arm in the passive position.

In FIG. 2 the arrow 50 is positioned on the arrow rest arm 28 of the arrow rest holder assembly 10 that is mounted on the bow handle riser portion 60 and the arrow holder arm 26 is in the passive, resting, position behind the arrow 50.

Figure 3:
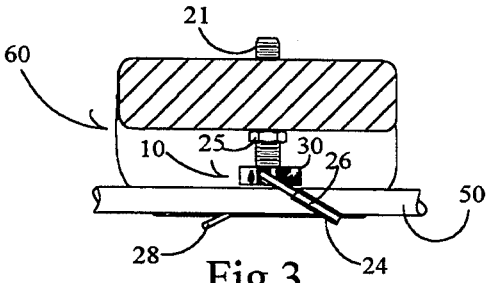
FIG. 3 is a top plan sectional view taken along the lines of 3—3 of FIG. 1 of an arrow rest with integrated arrow holder according to the present invention in combination with a fragmentary representation of an arrow with the holding arm in the holding, active position.
Figure 9:
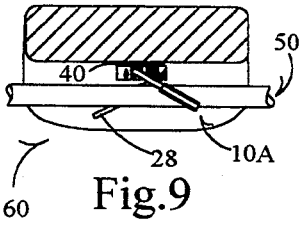
FIG. 9 is a top plan sectional view taken along the lines of 3—3 of FIG. 1 of an alternate embodiment of the present invention in combination with a fragmentary representation of an arrow.

In FIG. 3 the arrow rest holder assembly's 10 threaded rod 21 is fixedly attached within a transverse threaded through hole in the bow handle riser portion 60. A lock nut 25 is used to secure the assembly 10. The arrow holder arm 26 is positioned on top of the arrow 50 in the holding position by moving the arm 26, off of the inclined shelf 30 and rotating the arm 26, outward, clockwise, away from the bow handle riser 60. In the archery industry a standard threaded bore has been established for the bow handle and the vast majority of bows being sold today are bored and threaded according to this standard; although some types of bows are not. In FIG. 9 a bow handle riser portion 60 is shown without the through hole. The arrow rest holder assembly 10A is shown fixedly attached with an adhesive pad 40 to the bow handle riser portion 60.

Figure 4:
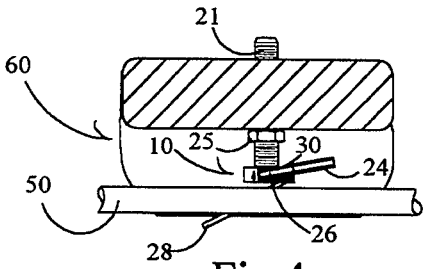
FIG. 4 is a top plan sectional view taken along the lines of 4—4 of FIG. 2 of an arrow rest with integrated arrow holder according to the present invention in combination with a fragmentary representation of an arrow with the holding arm in the passive position.

In FIG. 4 the arrow holder arm 26 is behind the arrow 50 in the passive position resting on the inclined shelf 30. The arrow holder arm 26 is rotated inward, counter clockwise, towards the bow handle riser portion 60 as the arrow 50 is drawn.

Figure 5:
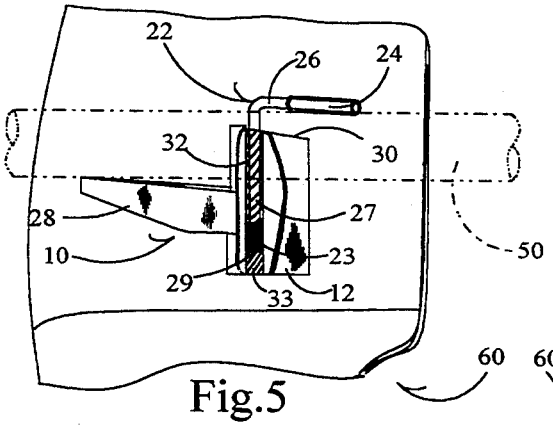
FIG. 5 is a front, cut-a-way, sectional, elevation with phantom lines view of an arrow rest with integrated arrow holder according to the present invention in combination with a fragmentary representation of a bow and arrow with the holding arm in the holding, active position.

In FIG. 5 body member 12 is generally rectangular and planar in shape and has a one piece performed arrow rest arm 28 projecting from its front surface and angled in the direction the arrow 50 will travel upon release. Through the cut-a-way, in body member 12, can be seen a rod bore 32. This rod bore 32 is sized incremental to the rod support arm 27 that it houses. A larger bore, in-line and directly below the rod bore 32, is the spring bore 33. The spring bore 33 is sized incremental to the tension or compression spring 23 that it houses. The tension spring 23 girdles the lower portion of the L-shaped member 22, the rod support arm 27, and is held in place by a permanently attached spring retainer 29. The spring 23 compresses against the bottom of the rod bore 32 when the arrow holder arm 26 of the L-shaped member 22 is raised off its inclined shelf 30 and rotated outward, clockwise, away from the bow handle riser portion 60 to its holding position on top of the arrow 50. The compression spring's tension urges the arrow holder arm 26 downward, wedging the arrow 50 against the arrow rest arm 28. The arrow 50 is held in this position until the arrow 50 is drawn back by the archer. As the arrow 50 is drawn the arrow holder arm 26 is rotated counter clockwise, back toward the handle riser portion 60 by the friction created between the arrow holder arm sleeve 24 and the arrow's top surface. As the arrow 50 moves back the arrow holder arm 26 is pulled with it until it has rotated counter clockwise to such a degree that it can no longer maintain its position on top of the arrow and is urged downward by the compression or tension spring 23 to its passive position on inclined shelf 30. The arrow holder arm sleeve 24, although not absolutely essential to the operation of the arrow rest holder assembly 10, is desirable. The arrow holder arm sleeve 24 should be composed of a soft flexible rubber or vinyl material. This type of material will increase the surface tension between the arrow holder arm 26 and the arrow 50 thus reducing the possibility of any slippage. An additional benefit of this flexible sleeve 24 is its noise reduction value which is greatly appreciated by the bowhunter.

Figure 6:
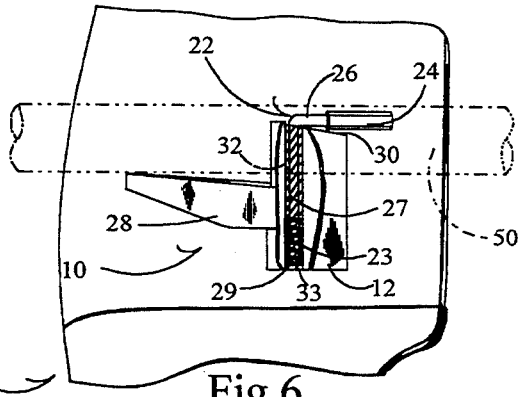
FIG. 6 is a front, cut-a-way, sectional, elevation with phantom lines view of an arrow rest with integrated arrow holder according to the present invention in combination with a fragmentary representation of a bow and arrow with the holding arm in the passive position.

In FIG. 6 the arrow holder arm 26 is in its passive position resting on the inclined shelf 30 with the tension spring 23 relaxed. The inclined shelf 30 is angled so that the arrow holder arm 26 when urged by the compression or tension spring 23 will come to rest angled towards the bow handle riser portion 60, as shown in FIG. 4. In this position the arrow holder arm 26 will have minimal interference with the arrow's fletching. The angle or taper of the inclined shelf 30 will depend on the shape of the arrow holder arm 26. The preferred embodiment of arrow holder arm 26, as shown, is straight, but a curved arrow holder arm 26A, shown in FIG. 8, would be preferred with certain bow, arrow, and fletching combinations. Although the inclined shelf 30 and tension spring 23 are sufficient to guide the arrow holder arm 26 to its desired position a compression or tension spring with inward, counter clockwise, torsional bias could also be employed. This additional urging will insure that elongated, curved, and large arrow holder arms 26A will return to their predetermined location.

Figure 7:
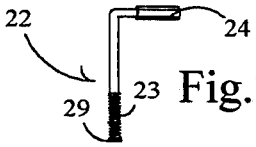
FIG. 7 is a top plan view of the assembled component parts of the L-shaped member of the present invention.

FIG. 7 shows the L-shaped member 22, tension spring 23, spring retainer 29, and arrow holder arm sleeve 24, assembled.

Figure 8:
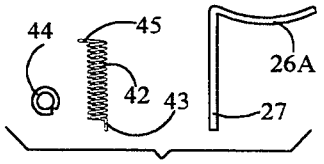
FIG. 8 is a top plan view of the component parts of an alternate embodiment of the L-shaped member of the present invention along with a torsionally biased compression, or tension spring, and notched spring retainer.

FIG. 8 shows an elongated curved arrow holder arm 26A. Various size and shape arrow holder arms 26A could be formed and adapted to the different combination of bow handles, arrow fletching, and mounting means employed. The alternate embodiment 10A, shown in FIG. 9, is mounted to the side of the riser 60 with and adhesive pad. In this method of attachment the straight arrow holder arm 26 in its passive position would be close to the riser 60 making it difficult to finger. A curved, elongated arm 26A would be desirable. A torsionally biased compression or tension spring 42 is shown. Also shown is a notched spring retainer 44 which is permanently mounted to the lower end of the rod support arm 27 and is necessary to impart torsion to the spring. The torsionally biased tension spring 42 has its lower end 43 secured in the notched spring retainer 44 and the upper end 45 positioned at the top of the spring bore 33. A torsionally biased tension spring 42 could be used with larger arrow holder arms such as 26A to increase inward movement and assist the inclined shelf 30 in bringing the arm 26A to its designated position.

Figure 10:
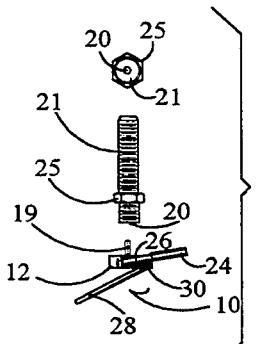
FIG. 10 is a top plan view of the preferred embodiment of the present invention.
Figure 10A:
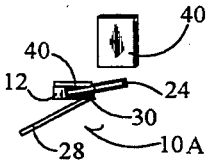
FIG. 10A is a top plan view of the component parts of an alternate embodiment of the present invention.

FIG. 9 is an alternate embodiment, whose component parts are shown in FIG. 10A, where the arrow rest holder assembly 10A is mounted directly to the bow handle riser portion 60 with an adhesive pad 40. This can be done once the threaded pin projection 19, shown in FIG: 10, has been removed from the back of the arrow rest holder assembly 10. All embodiments are formed from a synthetic polymeric material that is flexible and resilient, but capable of being cut. The threaded pin projection 19 is simply cut off.

Although the preferred material of all parts of the embodiments, except the spring, is a flexible polymeric, the threaded rod 21 and lock nut 25 could be made of metal such as brass.

FIG. 10 shows the preferred embodiment. The arrow rest holder assembly 10 has a threaded pin projection 19 protruding from the back of the body member 12. The threaded rod 21 is bored in the center and parrallel to its length with a threaded bore 20 sized to receive the threaded pin projection 19. The threaded rod 21 is first threaded through the bow handle riser portion and then the body member 12 with threaded pin projection 19 is threaded into the receiving threaded bore 20. The arrow rest holder assembly 10 can then be locked in place with the lock nut 25.

FIG. 10A shows the component parts of an alternate embodiment, as illustrated in FIG. 9, where the threaded pin projection 19, shown in FIG. 10, has been removed from the back of the body member 12. An adhesive pad 40 is affixed. This alternate embodiment can be used on bows without the archery industries standard threaded bored riser.

Figure 10B:
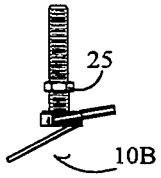
FIG. 10B is a top plan view of the preferred embodiment of the present invention as a one piece molded unit.

FIG. 10B shows the preferred embodiment as a one piece molded unit. This embodiment would be simply threaded through the standard threaded riser and locked in place with the locking nut 25.

SUMMARY, RAMIFICATIONS, AND SCOPE

It can now be seen that the arrow rest with integrated arrow holder is a simple and inexpensive device that is both an arrow rest and an arrow holder. It will hold an arrow in place prior to being drawn and released, and it serves as an arrow rest upon release guiding the arrow through its launch. Additionally, because of the ready availability of the arrow holding feature, safety in the sport of archery is increased.

Although the description above contains many specifics they should not be construed as limiting the scope of the invention but merely providing illustrations of some of the presently preferred embodiments of this invention.

Thus the scope of the invention should be determined by the appended claims and their legal equivalents, rather than by the examples given.

The embodiments of this invention in which an exclusive property or privilege is claimed are defined as follows:

1. In combination with a bow handle riser portion and nocked arrow, an arrow rest holder assembly comprising:

a mounting means for securing said arrow rest holder assembly to said bow handle riser portion;

a body means having a top edge shelf, and at least one arrow rest arm projecting from said body means generally in the direction of arrow flight such that said nocked arrow can rest thereon;

said body means having a rod bore and larger diameter spring bore in-line and parallel to said bow handle riser and generally perpendicular to the line of arrow flight, with said rod bore initiating at said top shelf, and said spring bore below said rod bore;

a generally L-shaped arrow retainer member;

the bores rotatably receiving one leg of said L-shaped member, said one leg terminating in a spring retainer and girdled by a spring means housed in said spring bore, said spring acts between said rod bore and said spring retainer in compression to bias said L-shaped member downward;

said other leg of said L-shape member, termed an arrow holder arm, positioned to engage the top of said nocked arrow and bias the arrow downwardly into engagement with said arrow rest arm, thus causing the arrow to be pinched between said arrow holder arm and said arrow rest arm, with friction created between said arrow and said arrow holder arm;

said arrow holder arm being at a level above said shelf when engaged with an arrow, such that as the arrow is drawn rearwardly, said friction causes the arrow holder arm to rotate rearwardly and ultimately out of contact with the arrow, at which time the spring further biases the arrow holder arm down onto the shelf, such that upon forward movement of the arrow, the arrow holder arm is no longer in engagement with the arrow.

2. The arrow rest holder assembly of claim 1 wherein said mounting means is an adhesive pad affixed to a back surface of said body means whereby said arrow rest holder assembly is adhesively affixed to said bow handle riser portion.

3. The arrow rest holder of claim 1 wherein said body means further includes a threaded pin projection protruding perpendicular from its back surface.

4. The arrow rest holder of claim 3 wherein said threaded pin projection is received by a threaded bore in a threaded rod, said threaded rod is threaded through a standard threaded bore in the riser, and secured with a lock nut.

5. The arrow rest holder assembly of claim 4 wherein said body means and said threaded pin are a one-piece molded part.

6. The arrow rest holder of claim 1 wherein said top edge shelf is inclined in a downward direction toward said riser such that as said arrow holding arm contacts said incline, and is urged downward by said spring means, the arrow holding arm will rotate inward toward said bow handle riser portion.

7. The arrow rest holder assembly of claim 1 wherein said spring means is torsionally biased to rotate said one leg and associated arrow holder arm toward said bow handle riser portion.

8. The arrow rest holder assembly of claim 1 wherein said arrow holder arm is curved.

9. The arrow rest holder assembly of claim 1 further including a sleeve around said arrow holer arm.

10. The arrow rest holder assembly of claim 9 wherein said arrow holder arm sleeve is composed of a friction enhancing material.

11. The arrow rest holder of claim 1 wherein said body means further includes a threaded rod integrally molded therewith, said threaded rod is adapted to be threaded through a standard threaded bore in the riser and secured with a lock nut.

12. In combination with a bow handle riser portion and nocked arrow, an arrow rest holder assembly comprising:

a body means having a generally planar shape, a top edge shelf, and an arrow rest arm projecting from a front surface generally in the direction of arrow flight such that said nocked arrow can rest thereon, said top edge shelf is inclined downwardly toward said riser;

said body means having an adhesive pad affixed to its back surface for adhesively mounting said arrow rest holder assembly to said bow handle riser portion;

said body means having a rod bore and larger diameter spring bore, in-line and parallel to said front surface, the bores generally perpendicular to the line of arrow flight, with said rod bore initiating at said top shelf, and said spring bore below said rod bore;

a generally L-shaped arrow retainer member;

the bores rotatably receiving one leg of said L-shaped member, said one leg terminating in a spring retainer and girdled by a spring means housed in said spring bore, said spring acts between said rod bore and said spring retainer in compression to bias said L-shaped member downward;

said other leg of said L-shaped member, termed an arrow holder arm, surrounded with a sleeve of friction enhancing material, and positioned to engage the top of said nocked arrow and bias the arrow downwardly into engagement with said arrow rest arm, thus causing the arrow to be pinched between said arrow holder arm and said arrow rest arm, with friction created between said arrow and said arrow holder arm, said arrow holder arm being at a level above said shelf when engaged with an arrow, such that as the arrow is drawn rearwardly, said friction causes the arrow holder arm to rotate rearwardly and ultimately out of contact with the arrow, at which time the spring further biases the arrow holder arm down onto the inclined shelf, such that upon forward movement of the arrow, the arrow holder arm is no longer in engagement with the arrow.

13. The arrow rest holder assembly of claim 11 wherein said spring means is torsionally biased to rotate said one leg and associated arrow holder arm toward said bow handle riser portion.

14. The arrow holder assembly of claim 11 wherein said arrow holder arm is curved.

15. In combination with a bow handle riser portion and nocked arrow, an arrow rest holder assembly comprising:

a body means having a generally planar shape, a top edge shelf, and an arrow rest arm projecting from a front surface generally in the direction of arrow flight such that said nocked arrow can rest thereon, said top edge shelf is inclined downwardly toward said riser;

a threaded pin projecting perpendicularly from a back surface of the body, said threaded pin receivable in a threaded bore of a threaded rod, said threaded rod receivable in a standard bore in the riser and securable with a lock nut;

said body means having a rod bore and larger diameter spring bore, in-line and parallel to said front surface, the bores generally perpendicular to the line of arrow flight, with said rod bore initiating at said top shelf, and said spring bore below said rod bore;

a generally L-shaped arrow retainer member;

the bores rotatably receiving one leg of said L-shaped member, said one leg terminating in a spring retainer and girdled by a spring means housed in said spring bore, said spring acts between said rod bore and said spring retainer in compression to bias said L-shaped member downward;

said other leg of said L-shaped member, termed an arrow holder arm, surrounded with a sleeve, and positioned to engage the top of said nocked arrow and bias the arrow downwardly into engagement with said arrow rest arm, thus causing the arrow to be pinched between said arrow holder arm and said arrow rest arm, with friction created between said arrow and said arrow holder arm, said arrow holder arm being at a level above said shelf when engaged with an arrow, such that as the arrow is drawn rearwardly, said friction causes the arrow holder arm to rotate rearwardly and ultimately out of contact with the arrow, at which time the spring further biases the arrow holder arm down onto the inclined shelf, such that upon forward movement of the arrow, the arrow holder arm is no longer in engagement with the arrow.

16. The arrow rest holder assembly of claim 14 wherein said spring means is torsionally biased to rotate said one leg and associated arrow holder arm toward said bow handle riser portion.

17. The arrow rest holder assembly of claim 14 wherein said arrow holder arm is curved.

18. The arrow rest holder of claim 14 wherein said sleeve is composed of a friction enhancing material.

* * * * *